United States Patent [19]

Elspass

[11] Patent Number: 4,508,007

[45] Date of Patent: Apr. 2, 1985

[54] LOCKING ARRANGEMENT FOR THE ELEVATING MECHANISM OF A GUN BARREL

[75] Inventor: Marold Elspass, Kaast, Fed. Rep. of Germany

[73] Assignee: Rheinmetall GmbH, Düsseldorf, Fed. Rep. of Germany

[21] Appl. No.: 459,688

[22] Filed: Jan. 20, 1983

[30] Foreign Application Priority Data

Feb. 11, 1982 [DE] Fed. Rep. of Germany ..... 3204721

[51] Int. Cl.[3] ..... F41F 21/00

[52] U.S. Cl. ..... 89/37.11; 89/45

[58] Field of Search ..... 89/1.802, 1.805, 37 H, 89/40 K, 41 R, 45

[56] References Cited

U.S. PATENT DOCUMENTS 2,792,757 5/1957 Carlberg et al. ..... 89/1.802

*Primary Examiner*—Stephen C. Bentley

[57] ABSTRACT

A weapon having a gun barrel and a gun elevating mechanism and a gun traversing mechanism respectively operatively connected to said gun barrel. A separate fully automatic loading mechanism also is operatively connected to said gun barrel. This gun barrel is to be maintained during the loading process by the gun elevating mechanism into an index position which is continuously attainable in the same short time period.

This object is achieved by having the gun elevating and gun traversing mechanisms provided with a common locking arrangement whereby the gun barrel disposed in the gun elevating mechanism is precisely held in an index position during loading. The locking is effected by means of a drive and brake unit which is mounted on the gun traversing mechanism. A claw is rotated by the brake and drive unit and is adapted to selectively clamp a bolt secured to the gun barrel when it is in a position corresponding to the required index position for loading. At the termination of the loading process and return-rotation of the claw into its starting position jointly with the gun elevating mechanism the bolt, and consequently the gun barrel, is swingable over a predetermined angular range about the trunnion axis of the gun cradle of the weapon.

9 Claims, 6 Drawing Figures

LOCKING ARRANGEMENT FOR THE ELEVATING MECHANISM OF A GUN BARREL

BACKGROUND OF THE INVENTION

With known gun barrel weapons having automatic elevation adjusting mechanisms mounted in separate loading arrangements it is difficult to obtain a precise loading position, in which a friction-less loading from a loader is possible. Because it is desirable to provide a high firing cadence for such types of gun barrel weapons, the time period for the loading process is strongly restricted so that during the available time only an inadequate loading position for the weapon elevating mechanism can be attained.

Even with electrically-mechanically driven aiming mechanisms a migrating of the elevating mechanism relative to the loading mechanism can not totally be avoided because the elevating mechanism continues to oscillate in a specific tolerance range of the weapon stabilizing arrangement and by means of a subsequent braking step reaches a loading position which preponderantly deviates from the index position.

SUMMARY OF THE INVENTION

It is an object of this invention to avoid the aforedescribed drawbacks in the elevating mechanism for a gun barrel in such a way that this elevating mechanism can be adjusted relative to an automatic loading arrangement in a constant uniform index position during the loading time period that is available. By means of a hang up of the elevating adjusting mechanism in a precise and time-independent index position a friction-less loading process without delay caused by load position corrections is made possible.

The invention therefore makes it possible to maintain the elevating mechanism in the required index position for loading in a cadence-independent very short time period which is available during the loading process of a gun barrel weapon and which is precisely maintained. This index position is attained by means of a locking arrangement independently from the time consuming loading position correction by means of arranging the locking mechanism at the weapon traversing mechanism and the weapon elevating mechanism.

It has been found to be particularly advantageous to provide a locking arrangement which is capable of maintaining a continuously identical index position for the loading process with fully automatic loading arrangements which are separate from the elevating adjusting mechanism. This locking arrangement operates properly even when influenced by outside forces which are independent from the weapon proper, such as for example disturbing influences which inhibit maintenance of the loading position, for example with continuously changing loading positions of the weapon traversing mechanism and the weapon elevating adjusting mechanism.

The locking arrangement of this invention distinguishes itself advantageously by the fact that during the locking process the required performance for the rotation of a drive and brake unit, which drives and brakes a claw, is effected by motor via a gear train whose rotational velocity and torque is synchronized in as short a time as possible and that during this braking process a sufficient security for the arresting of a bolt is furnished.

The construction of the claw is advantageously such that, already prior to reaching half of the maximum locking rotation of the claw, the bolt which is secured to the elevating adjusting mechanism of the weapon is held in a position in which only still a minimal opertional movement of the elevating adjusting part is available; therefore when this holding position is attained, the supporting members for the elevating adjusting part can be switched off via an end switch arrangement, which supporting members can again, however, after termination of the loading process and the return rotation of the claw in the holding position assume the supporting function of the elevating adjusting mechanism.

The diametrical arrangement of identically shaped jaws in the claw permits, when the claw is in the unlocked position, of a swinging through upwardly and downwardly of the oval bolt which is secured to the weapon elevating adjusting part about the trunnion axis. By means of a predetermined rotational movement of the claw, on the one hand, as a result of the oval shape of the bolt, and on the other hand, due to the shape of the exchangeable wear-resistant wearplates a quick reduction of the space between bolt and wearplate is attained, whereby by two corresponding diametrically oppositely arranged surfaces of the wearplates the locking of the bolt at mutually dependent steps can be carried out. The shape and composition of the wearplates and bolt represent therefore a further advance in the state of the art, because even with high impact loads of short duration the locking function remains intact.

A further advantage provided by the invention resides in the mounting of the locking arrangement in the region between trunnion axis and the breech, preferably in the vicinity of the breech, so that by locking in the index position an exact continuous identical loading position is maintained, whereby a correction of the adjustment of the bolt relative to the claw in the direction of the gun barrel axis is possible and the manufacturing tolerance can be compensated by the locking arrangement in the axial direction of the bolt.

BRIEF DESCRIPTION OF THE DRAWING

With these and other objects in view, which will become apparent in the following detailed description, the present invention, which is shown by example only, will be clearly understood in connection with the accompanying drawing, in which:

FIG. 4*a* illustrates the unlocked position of the bolt;

FIG. 4*b* illustrates the holding position of the bolt; and

FIG. 4*c* illustrates the locked position of the bolt.

DETAILED DESCRIPTION

Figure 1:
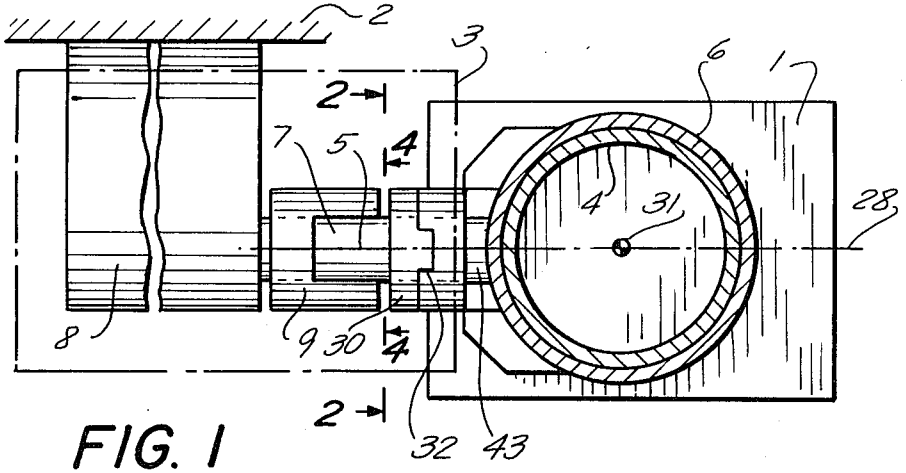
FIG. 1 is a simplified schematic elevational view of a locking arrangement in accordance with the invention and is viewed in the direction of the gun barrel axis.

In FIG. 1 there is illustrated an elevation adjusting part 1 which is swingable about the axis 28 and which is rigidly connected to a gun barrel support 6 which is adapted to slidably support a gun barrel 4 in the direction of the gun barrel axis 31. By means of the action of a locking arrangement 3 the required index position 5 (see FIG. 2) of the swing region for the loading process. This index position is maintained by means of driving and braking. A drive and braking unit 8 is adapted to forwardly and rearwardly rotatably drive; this drive unit is operatively connected to the elevating adjusting part by way of a bolt 7 rigidly secured to the gun barrel support in a manner to be described hereinafter and a rotatable claw 9 surrounding the bolt 7 which drive unit 8 is rigidly mounted on a weapon traverse adjusting part 2 (see FIG. 1). The bolt 7, which is swingably upwardly and downwardly about the axis 28 and the index position 5, is adjustably mounted on a holder 43 by means of securing means 30, such as for example threaded bolts. The holder 43 is cast on, welded on or screwed on the gun barrel support 6. Thereby a precise positioning of the bolt 7 in the direction of the gun barrel axis 31 relative to the claw axis is made possible by a sliding guide means 32, for example by means of a tongue and groove arrangement.

Figure 2:
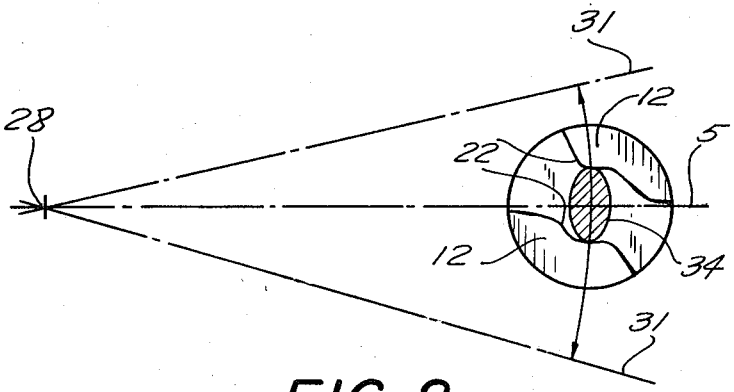
FIG. 2 is a sectional view along the plane defined by line 2—2 in FIG. 1 which plane passes through the jaws of the claw and through the locked bolt and which view also includes an illustration by means of a double arrow of the swing angle of the bolt.

FIG. 2 illustrates the index position 5 of the gun barrel axis 31 of the gun barrel which is swingable within the adjustment angle range $\beta$ about the axis 28. The angle range $\beta$ is limited by the weapon traverse adjusting part 2 (see FIG. 1). This index position 5 which must be continuously returned to and precisely maintained for the loading process accomplished by a fully automatic loading mechanism 44 which is mounted on the weapon traverse adjusting part 2 (see FIG. 1) is obtained by means of a predetermined shape 22 of the jaws 12 by means of which the bolt 7, having in cross-section an oval-shaped metal body 34, is locked in position (see FIG. 1).

Figure 3:
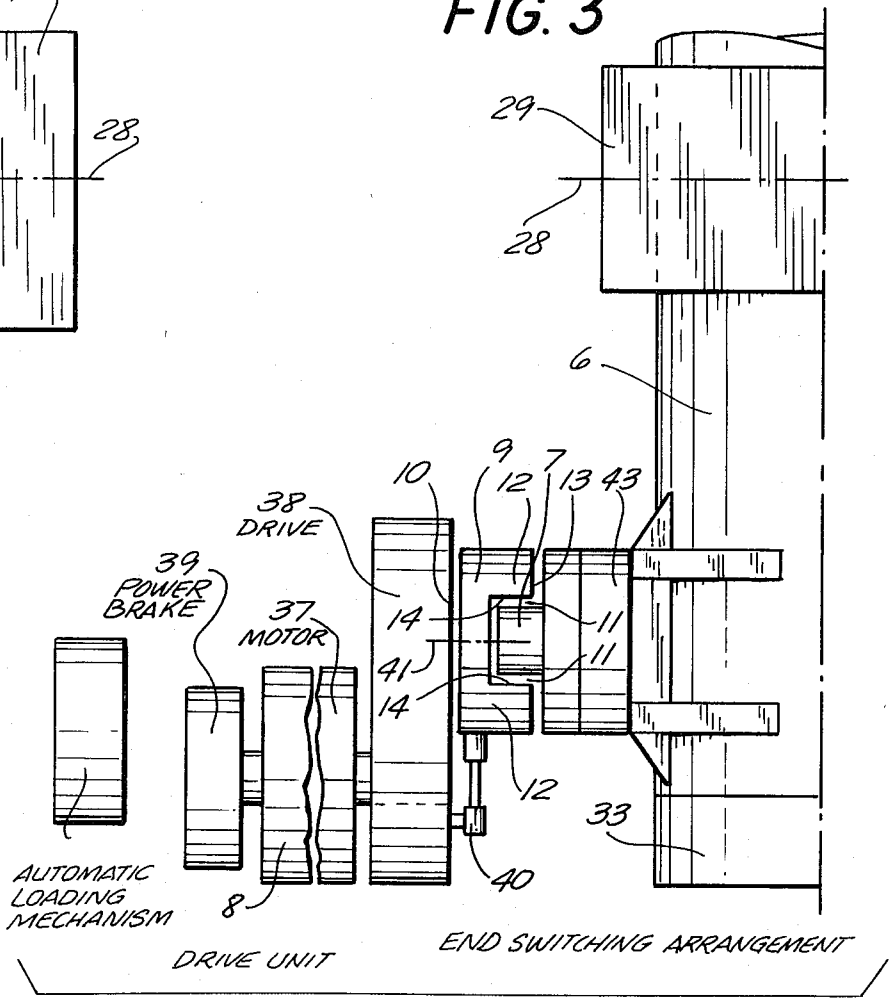
FIG. 3 is a plan view of the locking arrangement illustrating only half of the swingable elevationally adjustable gun barrel.

FIG. 3 depicts the manner of securing the holder 43 onto the gun barrel support 6 in the vicinity of the breech 33 and of the cradle 29 pivotably about the trunnion axis 28. The bolt 7 which is secured to the holder 43 is movable within the space defined by the jaws 12 of the claw 9 in an unlocked position, so that as a result of the free space 11 between the exterior periphery of the bolt 7 and the interior surface 14 of the jaws 12 the bolt 7 with the thereto joined weapon elevation adjusting part, can carry out the swinging elevation movement within the swing region of the angular range (FIG. 2). In order to carry out locking and unlocking of the bolt 7 by means of the jaws 12, which are arranged on the claw 9 opposite to its driving side 10, the claw 9 is drivable via motor 37 about the axis 41, whose drive 38 is synchronized with respect to torque and velocity, and which is brakable via a power brake 39 affording sufficient brake force in the locked position of the bolt 7 (FIG. 1). This procedure is therefore rapid, precise and continuously repeatable, because there is provided an end switching arrangement 40 on the drive 38, for monitoring the rotational movements of the claw 9, which drive 38 is rigidly mounted on the weapon traverse adjusting part 2. By means of this end switching arrangement 40 electrical control pulses are conducted to the motor 37 and the brake 39 as well as onto the members which support the weapon elevation adjusting part during the locking and unlocking.

Figure 4C:
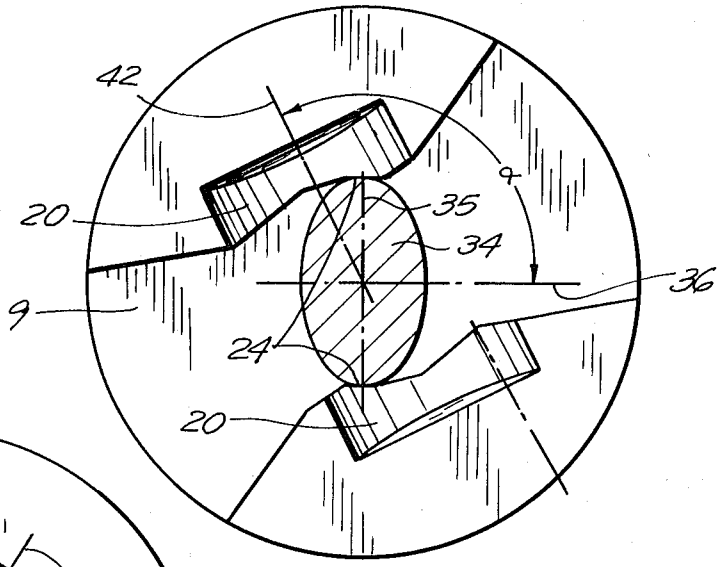
FIGS. 4*a*, 4*b*, 4*c* are cross-sectional views along the plane 4—4 in FIG. 1, whereby
Figure 4B:
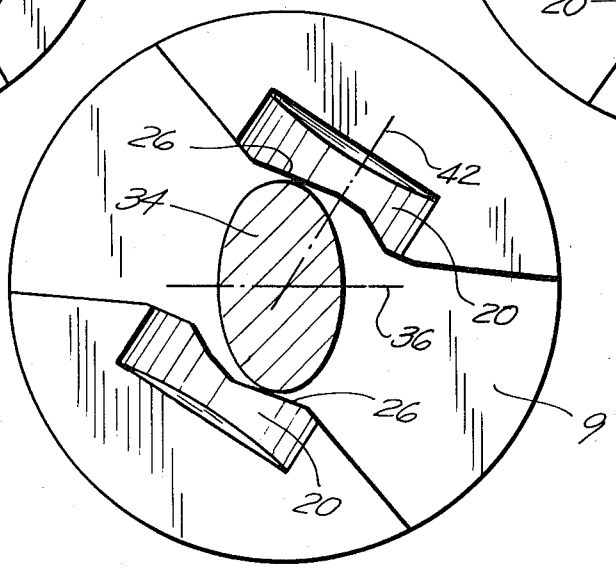
Figure 4A:
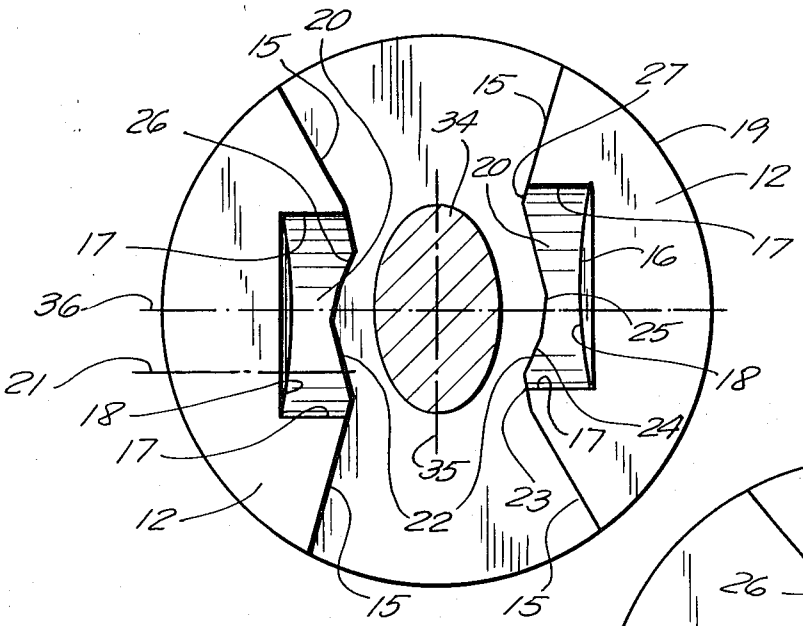

FIG. 4*a* clearly illustrates in detail the shape and construction of the jaws 12. Both jaws 12 have in the transfer region toward the in respective outer periphery 19 an inclined surface 15 which is adjoined by an open U-shaped recess 16 for each jaw, which recess 16 is open towards the axis 41. A wearplate 20 is matingly mounted in each recess 16 which wearplate includes the surface 23, 24, 25, 26, 27 which jointly define the wear surface 22. By means 21 not further illustrated in detail in the drawing the wearplates are operatively rigidly held in position and can be easily exchanged. The wearplates 20 are diametrically fixed by the side faces 17 and the base face 18 of the U-shaped recess 16, whereby the base surface 16 is arranged non-symmetrical with respect to the middle line of the claw 42. The metal body 34 forming the bolt 7 has an ellipsoidal, oval cross-section having a major axis 35 and a horizontal axis 36. The jaws 12 of the claw 9 are disposed relative to the metal body 34 in a non-locking inoperative position, in which the wearplates 20 are arranged both on the left and right side of the metal body 34 in such a way that, despite the specific oscillation of a stabilization arrangement, a contact between the metal body 34 and the surfaces 23 to 27 of the wearplate 20 does not take place.

FIG. 4*b* depicts the holding position of the metal body 34 by the surfaces 26 of the wearplate 20 within the now partially driven claw 9. In this position the oscillation movement is reduced to the minimal prevailing play distance between the surfaces 26 and the metal body 24. The surface 26 has already reached this holding position during the locking at that point in time before the still horizontally disposed middle line 42 has formed with the minor axis 36 half of the rotating angle which is possible for maximum rotation for locking.

FIG. 4*c* illustrates the locking position of the metal body 34 by means of the diametrically oppositely disposed surfaces 24 of the wearplates 20 after the claw 9 has been turned into its end position. The bolt 7 (FIG. 1) having the metal body 34 of oval-shaped cross-section is after further rotation of the middle line 42, still disposed in FIG. 4*a* in a horizontal position, about the angle relative to the minor axis 36, which angle can have as maximum limits between 90 and 130 degrees, so that the metal body 34 is firmly held via the sides 24 by means of the form locking at the end of the major axis 35.

The locking arrangement operates as follows:

The weapon elevation adjusting part 1 which oscillatingly remains in the inoperative position is disposed with its rigidly secured bolt 7, formed as a metal body 34 having an oval cross-section, in a region that can be grasped by the sides 26 of the wearplate 20. By means of a signal emitted by a stabilization arrangement not forming part of this invention the brake 39 is released and with reduced time delay the motor 37 initiates via the drive 38 the necessary rotational movement of the claw 9 for providing the locking. During the rotational movement there is effected a switching off of the members supporting the elevation adjusting part 1 by means of a signal of the end switching arrangement 40 when the hold position has been reached (see FIG. 4*b*) and when the locking position has been reached (see FIG. 4*c*) a further signal is emitted which announces the locking of the elevation adjusting part 1. In this locked position there is also switched off the motor 37 via the end switching arrangement 40 and the brake can be activated. The loading process for the gun barrel weapon can now begin. After the loading process has been terminated the operational sequence of the aforedescribed steps is now reversed.

The foregoing specification advantageously describes that, by means of an electro-mechanically driven locking arrangement a secure, rapid and precise form locking of an index position for the elevation adjusting part can be obtained which is required for the loading process relative to a separate loading arrangement, whereby the locking arrangement distinguishes itself by means of high wear resistance and an easily carried out exchange of the wearplates as well as by means of the possibility of an exact adjustment. In a further non-illustrated modification of the inventive arrangement there is provided that the locking arrangement is connected to an electro-hydraulic control mechanism in lieu of the electro-mechanical drive mechanism herein above described.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

I claim:

1. An improved weapon having a gun barrel and a gun elevating and gun traversing mechanism respectively operatively connected to said gun barrel, a separate fully automatic loading mechanism also being operatively mounted in said weapon, the improvement comprising in combination, a locking arrangement operatively connected to said gun elevating mechanism and to said gun traversing mechanism, said gun barrel being mounted in said gun elevating mechanism and being adapted to be precisely maintained in a predetermined index position during loading by said locking arrangement, wherein said gun elevating mechanism includes a gun barrel support, a bolt rigidly secured to said gun barrel support, a drive and brake unit operatively connected to said gun traversing mechanism, a claw being operatively connected to said drive and brake unit, said claw and bolt forming part of said locking arrangement and said index position being maintained by the claw lockingly clamping said bolt.

2. The improvement in a weapon as defined in claim 1, wherein said claw is cylindrically shaped and comprises two diametrically oppositely arranged identical jaw members which extend from a common cylindrical base, said two jaw members defining a non-linear groove therebetween of such shape that the inner side of each jaw includes a pair of surfaces which are inclined with respect to the exterior cylindrical peripheral surface of said claw and with respect to the axis of said claw and further includes a U-shaped recess disposed therebetween, said recess having a pair of side walls and a base wall, said side walls are parallel with respect to the horizontal middle dividing line and the axis of said claw and said base wall is perpendicular with respect to the horizontal middle dividing line and the axis of said claw when said claw is in the open inoperative position, said base wall of said U-shaped recesses being non-symmetrically arranged relative to said middle dividing line.

3. The improvement in a weapon as defined in claim 2, wherein in each one of said U-shaped recesses there is removably mounted a wear plate by means of first securing means, each one of said wear plates having a bolt-engaging contour surface, said gun barrel being pivotally mounted about a trunnion axis forming part of a gun cradle, said bolt-engaging contour surface of each wear plate defining two different locking positions in which said bolt is adapted to be lockingly held by said claw during the locking process.

4. The improvement in a weapon as defined in claim 3, wherein said bolt-engaging locking surface of each wear plate includes a plurality mutually inclined adjoining surfaces, whereby during said locking process said bolt is maintained by a first pair of said plurality of adjoining surfaces in a movement inhibiting position and by a second pair of said adjoining surfaces in a movement locking position.

5. The improvment in a weapon as defined in claim 4, wherein said bolt is movably mounted on a holder by means of second securing means, said holder being secured to said gun barrel support between said trunnion axis and the breech of said gun barrel, said second securing means including mutually engaging tongue and groove respectively forming part of said bolt and said holder so that said holder is adjustably movably mounted parallel to the gun barrel axis and can be precisely positioned relative to the axis of said claw.

6. The improvement in a weapon as defined in claim 5, wherein said bolt is formed by a metal body having an ellipsoidally shaped cross-section, the major axis of which ellipsoid is perpendicularly and the minor axis of which is parallelly arranged relative to said gun barrel axis.

7. The improvement in a weapon as defined in claim 6, wherein said drive and brake unit includes a motor, a gear train operatively connected to the motor, a brake, and an end switching arrangement, whereby after a predetermined rotation of said claw by means of said motor and gear train said locking position is reached when a signal is emitted by said end switching arrangement which causes the gun elevating adjusting mechanism to be deactivated, said index position only being determined when said locking position is effected by deactivating the motor and activating the brake.

8. The improvement in a weapon as defined in claim 7, wherein said gun elevating mechanism includes support means which are activated by said end switching arrangement after release of said brake and return-rotation of said claw by said motor via said gear train; said bolt being upwardly and downwardly swingable through said non-linear groove between said jaws after return-rotation of said claw to its initial position.

9. The improvement in a weapon as defined in claim 8, wherein said bolt is swingable about an angle relative to said claw to a final position of said claw, said angle laying in an angular range of 90 degrees to 130 degrees, said locking position being attained prior to exceeding half of the maximum swing angle.

* * * * *